United States Patent [19]

Papadatos

[11] 4,050,723

[45] Sept. 27, 1977

[54] MECHANISM FOR SECURING A DOOR IN OPEN OR CLOSED POSITION

[76] Inventor: George Papadatos, 703 6th Ave., Asbury Park, N.J.

[21] Appl. No.: 747,184

[22] Filed: Dec. 3, 1976

[30] Foreign Application Priority Data

May 17, 1976 Greece ..... 50740

[51] Int. Cl.[2] ..... E05C 1/02

[52] U.S. Cl. ..... 292/164; 292/177; 292/DIG. 15

[58] Field of Search ..... 292/153, 163, 164, 173, 292/177, 178, 179, 180, 181, 182, 175, DIG. 15; 16/85, 86 R, DIG. 10, DIG. 17

[56] References Cited

U.S. PATENT DOCUMENTS

| | | | |
|---|---|---|---|
| 288,028 | 11/1883 | Coultaus | 292/DIG. 15 X |
| 587,131 | 7/1897 | Markert | 292/DIG. 15 X |
| 643,850 | 2/1900 | Rogers | 292/181 |
| 648,299 | 4/1900 | Reeves | 292/DIG. 15 X |
| 658,122 | 9/1900 | Rogers | 292/181 |
| 777,408 | 12/1904 | Fletcher | 292/182 |
| 834,398 | 10/1906 | McKenzie | 292/163 |
| 1,768,326 | 6/1930 | Miller | 292/164 X |

FOREIGN PATENT DOCUMENTS

| | | | |
|---|---|---|---|
| 727,141 | 3/1932 | France | 292/180 |
| 810,969 | 8/1951 | Germany | 292/178 |
| 567,495 | 10/1957 | Italy | 292/DIG. 15 |
| 58,349 | 8/1923 | Sweden | 292/177 |

*Primary Examiner*—Roy D. Frazier
*Assistant Examiner*—Thomas J. Holko
*Attorney, Agent, or Firm*—Robert E. Burns; Emmanuel J. Lobato; Bruce L. Adams

[57] ABSTRACT

Mechanism for securing a door in open or closed position comprises a casing which is secured to the inside of the door near the bottom and has vertically aligned openings to receive a vertically movable hollow cylinder. The cylinder is biased upwardly by a helical spring in the casing, upward movement of the cylinder being limited by a plate which is affixed to the cylinder and engageable with the upper end wall of the casing. A plunger which is reciprocable in the cylinder is biased downwardly relative to the cylinder and is held in an upper or retracted position by a latch provided at the upper end of the cylinder. When the latch is released, the plunger is forced downwardly by its spring into engagement with the floor or with a socket set in the floor. When the cylinder is pushed downwardly far enough for the latch to engage the plunger and is then released, the cylinder and plunger are moved to their upper positions by the spring acting on the cylinder.

9 Claims, 4 Drawing Figures

MECHANISM FOR SECURING A DOOR IN OPEN OR CLOSED POSITION

FIELD OF INVENTION

The present invention relates to mechanism for securing a door in closed position or in selected open or partially open position.

BACKGROUND OF INVENTION

Many devices have heretofore been proposed for securing a door in closed position and for retaining it in open position. For example, a door can be secured in closed position by a lock or sliding bolt. However, such devices do not serve to retain a door in open or partially open position. For the latter purpose it has been proposed to use a plunger or a pivoted brace mounted near the bottom of the door and engageable with the floor. However, such devices are not capable of securing a door in closed position in a positive manner. Morever, they have been inconvenient to operate and have not been found to be wholly effective in retaining a door in open or partially open position.

SUMMARY OF INVENTION

It is accordingly an object of the present invention to provide a unitary mechanism for securing a door in closed position in a positive manner and for effectively retaining it in an open or partially open position. Moreover, the mechanism in accordance with the invention is convenient to operate and is operable in a reliable and effective manner.

In accordance with the invention the mechanism comprises a hollow cylinder which is vertically movable in a casing secured to the inner face of a door near the bottom. The cylinder is biased upwardly with respect to the casing and means is provided for limiting upward movement of the cylinder at a selected upper position. A plunger is longitudinally movable in the cylinder and extends below the lower end of the cylinder. A spring biases the plunger downwardly relative to the cylinder. A manually operable latch on the upper end of the cylinder engages the plunger to hold it in an upper retracted position in which the lower end of the plunger is above the floor. When the latch is released, the plunger is forced downwardly by its spring. When the door is in closed position, the plunger enters a socket recessed in the floor to secure the door closed in a positive manner. When the door is in selected open or partially open position, a resilient tip on the lower end of the plunger frictionally engages the floor to retain the door in its selected position. The spring pressure acting downwardly on the plunger presses the plunger firmly against the floor so as to retain the door effectively in the position selected. The plunger is conveniently retracted by pushing the cylinder downwardly until the latch on the cylinder again engages the plunger. When the cylinder is then released, its spring raises the cylinder together with the plunger to upper retracted position.

BRIEF DESCRIPTION OF DRAWINGS

The nature, objects and advantages of the invention will be more fully understood from the following description of a preferred embodiment shown by way of example in the accompanying drawings, in which.

Figure 1:
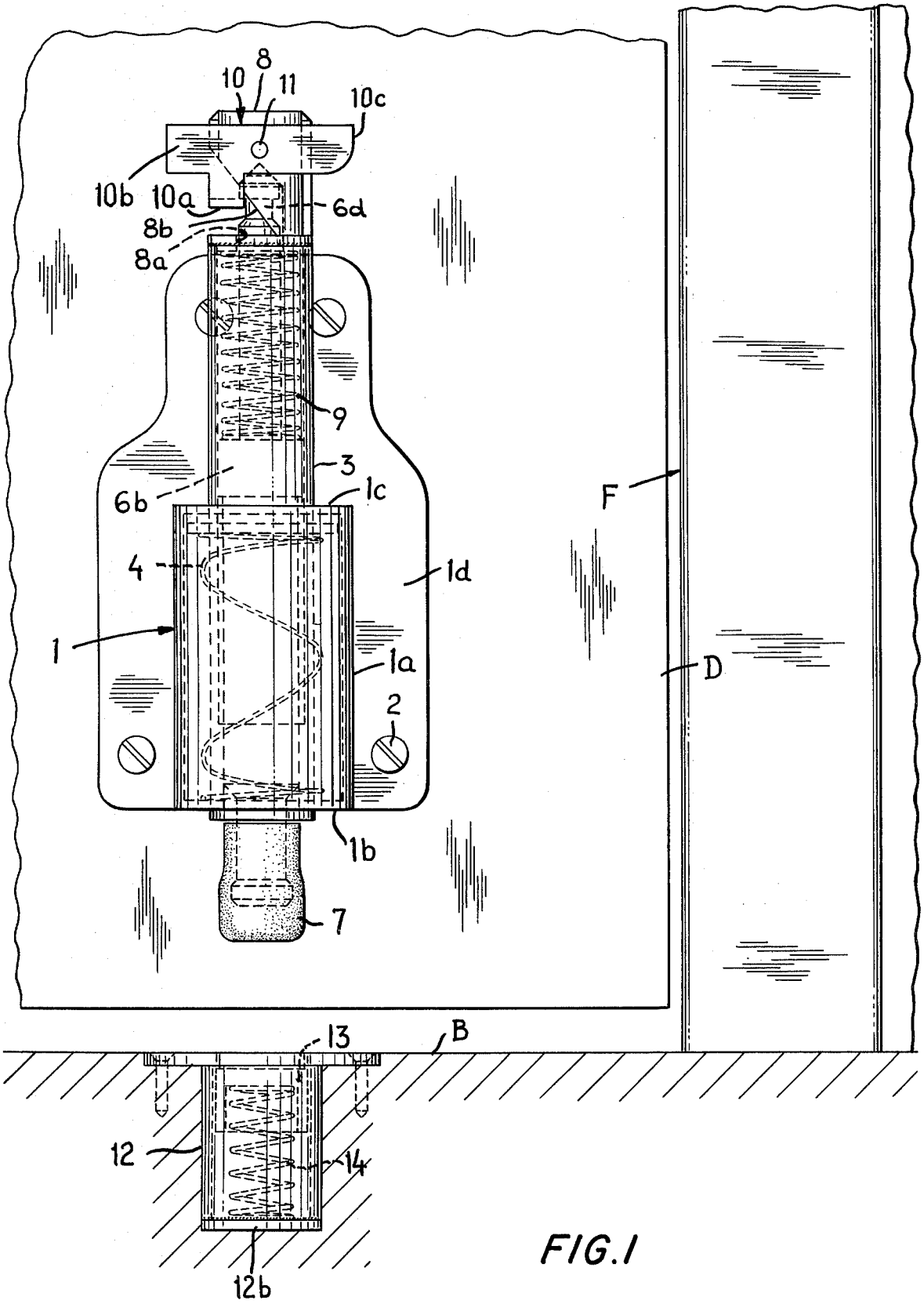
FIG. 1 is a front elevation of mechanism in accordance with the invention mounted on the inner surface of a door, the plunger being shown in upper retracted position.

DESCRIPTION OF PREFERRED EMBODIMENT:

As shown by way of example in the drawings, the mechanism in accordance with the present invention comprises a casing 1 which is mounted on the inner face of a door D near the bottom. The door D is suitably mounted in a door frame F, for example by hinges H. The casing 1 is located near the free vertical edge of the door, i.e. the edge remote from the hinges. The casing comprises a non-circular cylindrical portion having a side wall 1*a* and lower and upper end walls 1*b* and 1*c*. An integral flat base portion 1*d* is provided with holes to receive screws 2 for securing the casing to the door.

A hollow cylindrical member 3 is slidably received in circular openings provided in the upper and lower end walls of the casing 1 which guide the cylindrical member for longitudinal movement relative to the casing. The cylindrical member 3 is biased upwardly relative to the casing by a light helical spring 4 which surrounds the cylindrical member and acts between the lower end wall 1*b* of the casing and a non-circular transverse plate 5 which is secured to the cylindrical member 3, for example by welding. The plate 5 limits upward movement of the cylindrical member 3 to an upper position in which the plate 5 engages the upper end wall 1*c* of the casing. For the sake of clarity, the plate 5 is shown slightly below its uppermost position in FIG. 3. The plate 5 together with the spring 4 also limits downward movement of the cylindrical member 3 with respect to the casing. By reason of its non-circular shape which corresponds approximately to the internal cross section of the non-circular cylindrical portion of the casing, the plate 5 restrains rotation of the cylindrical member 3 relative to the casing but permits limited vertical longitudinal movement. When in its upper position, the cylindrical member 3 extends above the upper end wall 1*c* of the casing a distance at least approximately equal to the vertical length of the non-circular cylindrical portion of the casing, while the lower end of the cylindrical member 3 extends slightly below the lower end wall 1*b* of the casing.

A plunger 6 is longitudinally movable in the cylindrical member 3. The plunger 6 has a cylindrical portion 6*a* which is slidably received in a lower portion 3*a* of the cylindrical member 3. At the upper end of the cylindrical portion 6*a* there is a slightly enlarged cylindrical portion 6*b* which is engageable with an internal annular shoulder 3*b* of the cylindrical member 3 so as to limit downward movement of the plunger. Above the enlarged portion 6*b* there is an upperwardly extending stem portion 6*c* of reduced diameter. At its upper end the stem portion 6*c* is provided with detent means in the form of an annular groove 6*d*. At its lower end the plunger 6 has a reduced portion 6*e* provided at its lower end with an annular enlargement 6*f*. A tip 7 of rubber or plastic material fits over the lower end of the plunger and is retained by the enlarged portion 6*f*.

Figure 2:
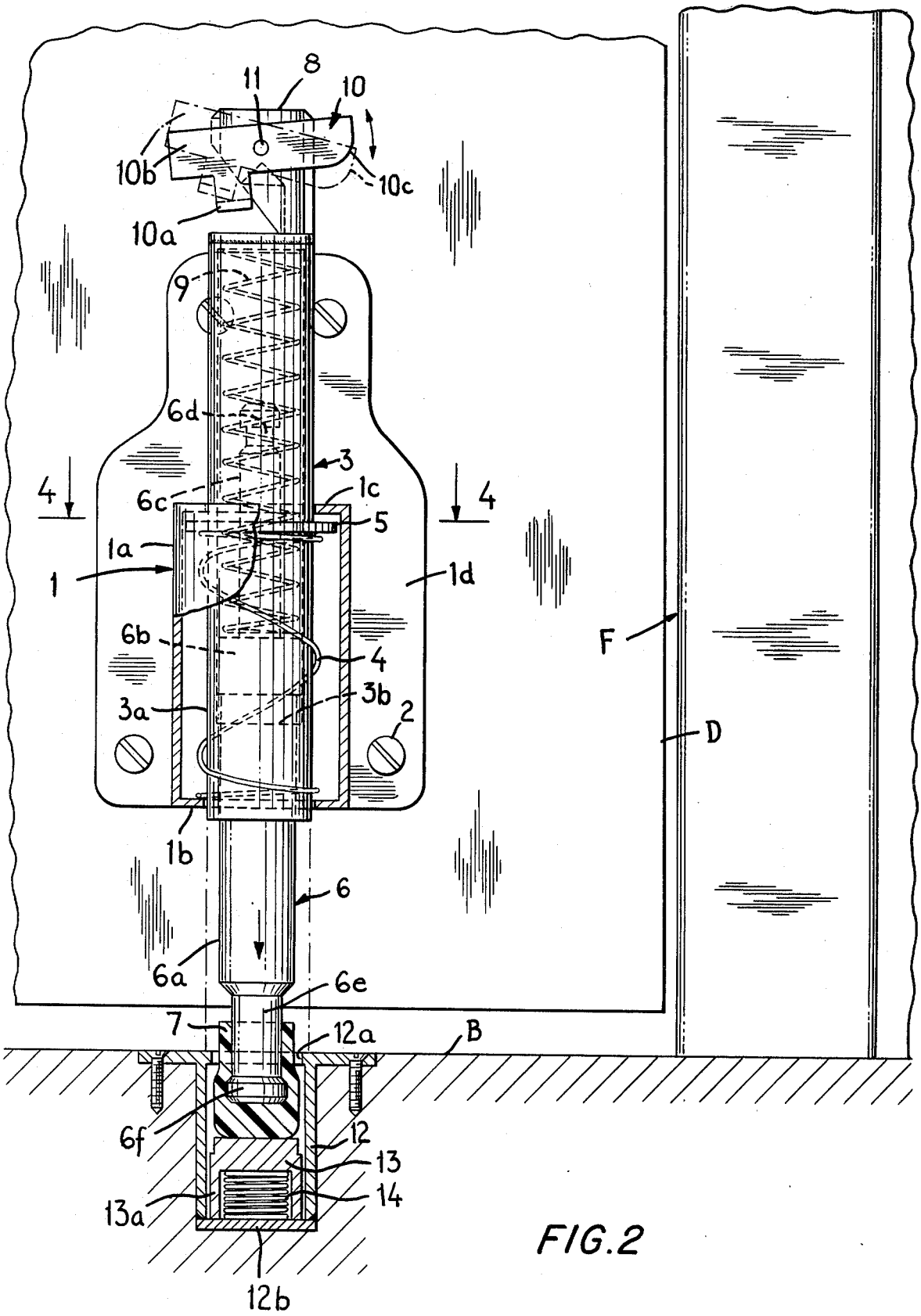
FIG. 2 is a similar view but with the plunger in lower position and with a portion broken away to show internal construction.

At its upper end the cylindrical member 3 is provided with a head portion 8 which is secured to the cylindrical member 3, for example by welding so as to be unitary therewith. A relatively strong helical spring 9 surrounds the stem portion 6c and acts between the head portion 8 and the enlarged cylindrical portion 6b of the plunger so as to bias the plunger downwardly relative to the cylindrical member 3. The head portion 8 is provided with an axial hole 8a to receive the upper end of the plunger and with a releasable latch 10 engageable in the annular groove 6d so as releasably to hold the plunger in an upper position against the bias of the spring 9. The latch 10 comprises a cross bar portion 10a connecting opposite parallel wing portions 10b which embrace the head portion 8 and are pivotally connected thereto by a transverse pivot pin 11. The head portion is provided with a notch 8b to accommodate the cross bar portion 10a of the latch 10 for engagement in the annular groove 6d at the top of the plunger 6 so as to hold the plunger in its upper position. End portions 10c of the wing portions 10b of the latch 10 extend laterally beyond the head portion 8 so as to be engageable, for example by a persons foot, to turn the latch in a clockwise direction as indicated by broken lines in FIG. 2 so as to release the plunger 6 for downward movement by the spring 9. The center of gravity of the latch 10 is to the left of the pivot pin 11 as seen in FIGS. 1 and 2 so that the latch is biased in a counterclockwise direction so as to engage the plunger. The upper end of the plunger is tapered so as to ride passed the latch when the plunger enters the hole 8a. Hence, when the plunger is moved upwardly relative to the cylindrical member 3 to its upper position, it is automatically latched so as to be retained in that position.

A cup-shaped socket 12 is provided in the floor B in position to receive the plunger 6 when the door is closed. The socket is flush with the floor. An inverted cup-shaped closure member 13 is longitudinally movable in the socket 12 and is biased upwardly by a helical compression spring 14. Upward movement of the closure member 13 is limited by a reduced portion 12a of the socket so as to retain the closure member in the socket. When the closure member 13 is in its uppermost position, its upper end is flush with the floor as illustrated in FIG. 1.

When the door D is in closed position and the latch 10 is released, the plunger 6 is moved downwardly by the spring 9 so as to enter the socket 12 as illustrated in FIG. 2. It will be seen that when the plunger enters the socket 12 it pushes the closure member 13 downwardly against the bias of the spring 14. Downward movement of the closure member 13 is limited by engagement of its skirt portion 13a with the bottom 12b of the socket. When the plunger 6 is in the socket 12 as illustrated in FIG. 2, the door is positively secured in closed position.

When it is desired to retract the plunger 6 so as to release the door, the cylindrical member 3 is pushed downwardly, for example by stepping on the upper end of the head portion 8. The cylindrical member 3 is thus moved downwardly until the upper end of the plunger 6 enters the hole 8a of the head portion and is secured by the latch 10. The cylindrical member 3 is then released, whereupon it is moved upwardly to its upper position by the spring 4 taking with it the plunger 6 which is thereby retracted to the position shown in FIG. 1.

Figure 3:
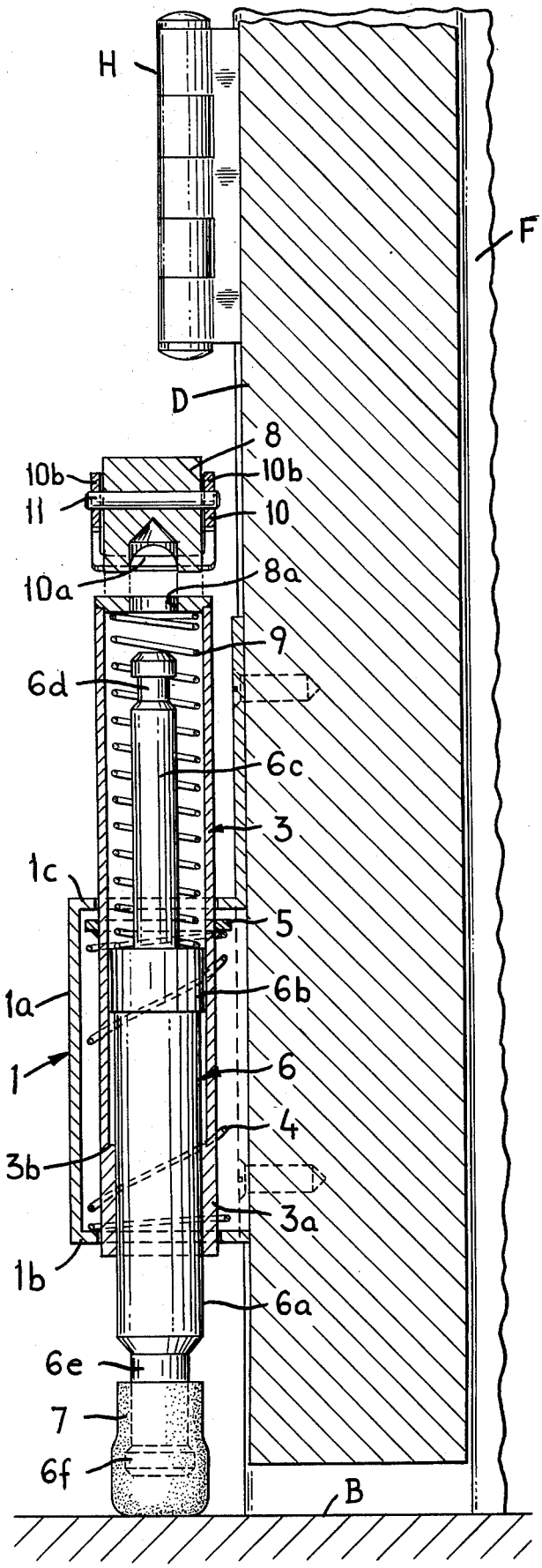
FIG. 3 is a side view of the mechanism shown partially in longitudinal section.
Figure 4:
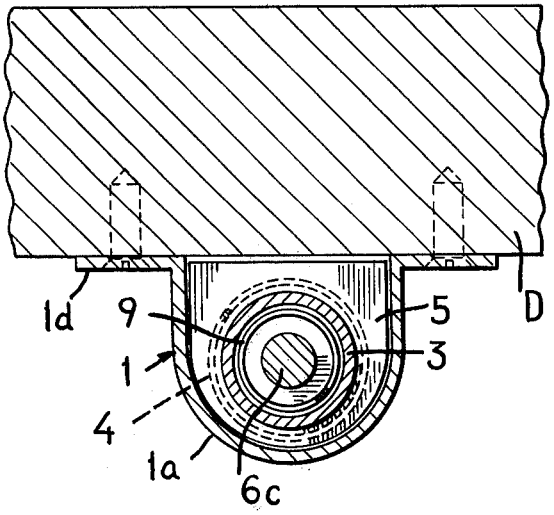
FIG. 4 is a cross section taken approximately on the line 4—4 in FIG. 2.

When it is desired to retain the door in open or partially open position, the latch 10 is released as described above. The plunger 6 is thereupon moved dowardly by the spring 9 so as to press the tip 7 firmly against the floor B as illustrated in FIG. 3. The door is thereby retained in selected position by frictional engagement of the tip 7 of the plunger 6 with the floor. As the spring 9 is relatively strong, the door is securely retained in selected position even if the floor is sloping or is uneven so that the distance between the bottom of the door and the floor is not uniform. When it is desired to release the door, the plunger 6 is retracted by pushing downwardly on the cylindrical member 3 for example with the foot and then releasing it as described above.

It will thus be seen that the mechanism in accordance with the present invention provides means for positively securing a door in closed position and for effectively retaining it in selected open or partially open position. If it is desired positively to secure the door in a position other than closed position, one or more additional sockets 12 can be provided at selected locations in the floor. Moreover, it will be seen that the mechanism in accordance with the invention is convenient to operate and is effective in its operation.

While a preferred embodiment of the invention has been illustrated in the drawings and is herein particularly described, it will be understood that many modifications can be made and that the invention is hence in no way limited to the illustrated embodiment.

What I claim is:

1. Mechanism for securing a door in open or closed position comprising a casing having vertically aligned openings, means for securing the casing to a door near the floor, a hollow cylinder received in said openings of the casing and guided by said openings for vertical lengthwise movement relative to the casing, first spring means for biasing said cylinder upwardly relative to the casing, means for limiting upward movement of said cylinder relative to the casing to position said cylinder in an upper position, a plunger received in said cylinder and longitudinally movable therein, second spring means for biasing said plunger downwardly relative to said cylinder, detent means on the upper end of said plunger, latch means on the upper end of said cylinder engageable with said detent means on the upper end of said plunger to hold said plunger in an upper position, means for manually releasing said latch means whereupon said plunger is pressed downwardly into engagement with the floor by said second spring biasing means, said cylinder being manually movable downwardly relative to said casing and said plunger from said upper position to a position in which said latch means again engages said detent means whereupon said cylinder and plunger are raised by said first spring biasing means to said upper position.

2. Mechanism according to claim 1, further comprising means for restraining said cylinder from rotation in said casing.

3. Mechanism according to claim 2, in which said means for restraining rotation of said cylinder includes a non-circular plate affixed to said cylinder and engaging a side wall of said casing to restrain rotation of said cylinder in said casing.

4. Mechanism according to claim 3, in which said plate is also engageable with an upper end wall of the casing to limit upward movement of said cylinder in the casing.

5. Mechanism according to claim 3, in which said first spring biasing means comprises a helical compression spring which surrounds said cylinder and acts between said plate and a lower end wall of said casing.

6. Mechanism according to claim 1, in which said latch means comprises a latch member pivotally mounted on an upper end portion of said cylinder.

7. Mechanism according to claim 6, in which said latch means has a release portion which is foot-engageable to release said latch means.

8. Mechanism according to claim 1, further comprising a resilient friction tip portion on the lower end of said plunger for frictional engagement with the floor to hold the door in selected position.

9. Mechanism according to claim 1, further comprising a socket set flush in the floor in position to receive said plunger, a closure member reciprocable in said socket, spring means in said socket for biasing said closure member upwardly in said socket and means for limiting upward movement of said closure member in said socket at a position substantially flush with the floor, said second spring means being stronger than said spring means in the socket, whereby said plunger depresses said closure member to enter the socket when said latch means is released with said plunger positioned in register with said socket.

* * * * *